US006979191B1

(12) United States Patent
Zink et al.

(10) Patent No.: US 6,979,191 B1
(45) Date of Patent: Dec. 27, 2005

(54) COMBUSTION APPARATUS AND METHOD FOR RADIATING WALL HEATING SYSTEM

(75) Inventors: Darton Zink, Tulsa, OK (US); Rex Isaacs, Tulsa, OK (US); John McDonald, Broken Arrow, OK (US); Tim Kirk, Morris, OK (US); Cody Little, Coweta, OK (US)

(73) Assignee: Zeeco, Inc., Tulsa, OK (US)

( * ) Notice: Subject to any disclaimer, the term of this patent is extended or adjusted under 35 U.S.C. 154(b) by 0 days.

(21) Appl. No.: 10/869,986

(22) Filed: Jun. 17, 2004

(51) Int. Cl.[7] ..... F23D 14/22

(52) U.S. Cl. ..... 431/174

(58) Field of Search ..... 34/174

(56) References Cited

U.S. PATENT DOCUMENTS

| | | | |
|---|---|---|---|
| 3,954,382 | A | 5/1976 | Hirose |
| 4,237,858 | A | 12/1980 | Goodnight et al. |
| 4,257,763 | A | 3/1981 | Reed |
| 4,289,474 | A | 9/1981 | Honda et al. |
| 4,505,666 | A | 3/1985 | Martin et al. |
| 4,945,841 | A | 8/1990 | Nakamachi et al. |
| 5,975,886 | A | 11/1999 | Philippe |
| 5,980,243 | A | 11/1999 | Surbey et al. |
| 6,499,990 | B1 | 12/2002 | Zink et al. |
| 2003/0148236 | A1 | 8/2003 | Joshi et al. |

*Primary Examiner*—Stephen Gravini
(74) *Attorney, Agent, or Firm*—Dennis D. Brown; Fellers, Snider, Blankenship, Bailey & Tippens, P.C.

(57) ABSTRACT

A burner and combustion method for a radiant wall heating system wherein each burner fuel ejector is positioned such that at least a substantial portion of the burner combustion air is discharged from an area beyond the ejector located the greatest distance from the radiant wall.

35 Claims, 4 Drawing Sheets

COMBUSTION APPARATUS AND METHOD FOR RADIATING WALL HEATING SYSTEM

FIELD OF THE INVENTION

The present invention relates to burners and combustion methods for use in heating systems having upwardly extending radiating walls for radiating combustion energy.

BACKGROUND OF THE INVENTION

Radiant wall heating systems are commonly employed in chemical, petroleum, and other industrial processes. A typical prior art radiant wall heating system 2 is illustrated in FIGS. 1 and 2. The prior art radiant wall system 2 comprises: a furnace, boiler, or other fired heater 4 having a housing 5, an outer wall 6, and a floor 8; a plurality of process tubes 10 which carry the process fluid through the housing 5; an upwardly extending radiating wall 12 within housing 5; and at least one radiant wall burner 14. The radiant wall 12 within heater 5 is typically comprised of a radiating ceramic tile material or other material which will radiate the combustion energy generated by burner 14 toward and onto the process tubes 10.

The prior art burner 14 shown in FIGS. 1 and 2 comprises: a burner housing 16 positioned primarily outside of the heater wall 6; a burner wall 18 which extends horizontally from burner housing 16 through the heater wall 6 and into the interior of the furnace housing 5; a combustion air flow passage 20 extending through burner housing 16 and burner wall 18; a damper or other regulating device 22 in burner housing 16 for regulating the flow of combustion air 26 through the burner 14; an upwardly facing flow passage opening 24 provided through the upper end of the burner wall 18 for delivering the combustion air 26 upwardly as illustrated in FIG. 1; a plurality of primary fuel ejectors 28 for ejecting some (typically most) of the burner fuel into a primary combustion stage 30; and a plurality of secondary fuel ejectors 32 for ejecting the remainder of the burner fuel into a secondary combustion stage 34. The combustion air 26 will typically be delivered to the burner 14 by forced circulation, natural draft, or a combination thereof. Although the prior art burner assembly 14 shown in FIG. 1 extends horizontally through the heater wall 8, it is also known in the art to extend the burner assembly vertically through the floor 8 of the heater.

Each of the fuel ejectors 28 and 32 will typically comprise a fuel ejection tip 36 or 38 secured on a vertical end portion of a fuel pipe 40 or 42. Each ejector tip 36 and 38 has one or more orifices or other flow ports provided therein for ejecting fuel in a desired direction and pattern. The ejection tips 38 provided on the secondary fuel ejectors 32 will typically be effective for ejecting fuel upwardly into a flat flame combustion stage 34 against the radiating wall 12.

As shown in FIG. 2, the upper end of the burner wall 18 provides a periphery 44 which surrounds and establishes the boundaries of the upwardly facing combustion air opening 24. A first (near) side 46 of the periphery 44 is positioned closest to the radiating wall 12 and establishes a near boundary 48 of the combustion air opening 24. A second (outer) side 50 of the periphery 44 is positioned furthest from the radiating wall 12 and establishes an outer boundary 52 of the combustion air opening 24. The near boundary 48 of opening 24 will include or consist of one or more "closest" point(s) 49 which is/are closer than any other portion of the upper opening 24 to the radiating wall 12. In like manner, the outer boundary 52 includes or consists of one or more "furthest" point(s) 53 which is/are further than any other portion of the upper opening 24 from the radiating wall 12.

As shown in FIG. 2, the upper discharge end of burner 14 has a rectangular shape so that the near boundary 48 of the upper opening 24 is a straight line segment which is adjacent to and runs parallel to the radiating wall 12. Because all portions of the near boundary line 48 are equidistant from the radiating wall 12, each point on line 48 is therefore a near boundary point "closest" to the radiating wall 12. Similarly, the outer boundary 52 of the upper opening 24 is also a straight line segment running parallel to the radiating wall 12. Thus, each point on line 52 is an outer boundary point which is "furthest" from the radiating wall 12. The linear outer boundary 52 and near boundary 48 of combustion air opening 24 are spaced apart a maximum width 54, as shown in FIG. 2, perpendicular to the radiating wall 12.

As illustrated in FIGS. 1 and 2, at least some of the ejectors 28 and 32 employed in the radiant wall burners heretofore known in the art are commonly positioned either in or beyond the outer peripheral wall 50 of the combustion air opening 24. Thus, the ejectors 28 will typically be spaced outwardly from the near boundary line 48 of the upper opening 24 by a distance 58 which exceeds the maximum width 54 of the opening 24.

As indicated above, the prior art radiant wall burner 14 is a staged fuel burner having a primary stage combustion zone 30 and a secondary stage combustion zone 34. An intended objective of the staged fuel burner is to lower the amount of $NO_X$ emissions produced in the combustion process. In the staged fuel design, excess air is typically present in the primary combustion stage 28 so that the overall temperature of the burner flame is lowered and the production of $NO_X$ compounds is thereby reduced.

Unfortunately, in the radiant wall burners heretofore used in the art, flue gas currents 60 within the heater 4 commonly act to pull the combustion flame 30 produced by ejectors 28 outwardly away from the radiating wall 12. This reduces the efficiency, effectiveness, and stability of the burner 14 and also reduces the overall efficiency and heating capacity of the radiant wall system 2. In addition, it is not uncommon that the flue gas currents 60 will pull the flame 30 outward to such a degree that it is very close to and/or impinges upon the process tubes 10. The impingement or near impingement of the burner flame 30 on the process tubes further diminishes the performance and reduces the efficiency of the heating system, can damage the process tubes 10 or other internal components, and can result in accelerated coke production and lay down within the tubes 10.

Thus, a need exists for an improved radiant wall burner and a better method for operating radiant wall systems which will provide greater flame stability and will prevent or at least significantly reduce the flame drift and impingement problems experienced with the prior art burners. The improved radiant wall burner and method will preferably also be effective for maintaining low $NO_X$ production rates and will most preferably be effective for further reducing $NO_x$ emissions.

SUMMARY OF THE INVENTION

The present invention provides an improved radiant wall burner and an improved method of producing combustion energy in radiant wall systems. The inventive burner and method satisfy the needs and alleviate the problems discussed above. The inventive burner and method are effective for both eliminating or at least substantially reducing flame drift and impingement problems while also reducing the production of harmful $NO_X$ emissions. In addition, the inventive burner and method provide improved operating stability and higher available turn-down ratios.

In one aspect, there is provided an improvement in a burner for use in a heating system having an upwardly extending radiating wall for radiating combustion energy. The burner includes a burner wall having an upper opening for delivering combustion air upwardly into the heating system. The upper opening has at least one near boundary point which will be closest to the radiating wall and at least one outer boundary point which will be furthest from the radiating wall. The upper opening has a maximum width perpendicular to the radiating wall and the burner includes one or more ejectors for ejecting a fuel. The improvement comprises each of the one or more ejectors of the burner being positioned such that it will be located between the radiating wall and a plane parallel to the radiating wall. The plane is located between the near boundary point and the outer boundary point at a distance from the near boundary point which is 75% of the maximum width.

In another aspect, there is provided an improvement in a burner for use in a heating system having an upwardly extending radiating wall for radiating combustion energy, wherein the burner includes a burner wall having a substantially rectangular upper opening for delivering combustion air. The substantially rectangular opening has a first side which will be positioned closest to the radiating wall and a second side, opposite the first side, that will be positioned furthest from the radiating wall. The substantially rectangular upper opening has a width between the first side and the second side and the burner includes one or more ejectors for ejecting a fuel. The improvement comprises each of the one of more ejectors of the burner being positioned such that it will be located between the radiating wall and a plane parallel to the radiating wall. The plane is located between the first side and the second side at a distance from the first side which is 75% of the width.

In another aspect, there is provided a method of producing combustion energy in a heating system having an upwardly extending radiating wall for radiating the combustion energy. The method uses a burner having one or more ejectors for ejecting a fuel and an opening for delivering combustion air. The method comprises the steps of: (a) ejecting the fuel from the one or more ejectors in a manner effective for producing an upwardly projecting flame pattern and (b) delivering the combustion air from the opening upwardly into the heating system such that less than half of the combustion air from the opening is delivered between the radiating wall and a horizontal line parallel to the radiating wall. The horizontal line is a line extending through an upper end centerpoint of at least one of the one or more ejectors located furthest from the radiating wall such that the burner does not have any ejector positioned outwardly from the radiating wall beyond the horizontal line.

Further aspects, features, and advantages of the present invention will be apparent to those skilled in the art upon examining the accompanying drawings and upon reading the following detailed description of the preferred embodiments.

DETAILED DESCRIPTION OF THE PREFERRED EMBODIMENTS

Figure 4:
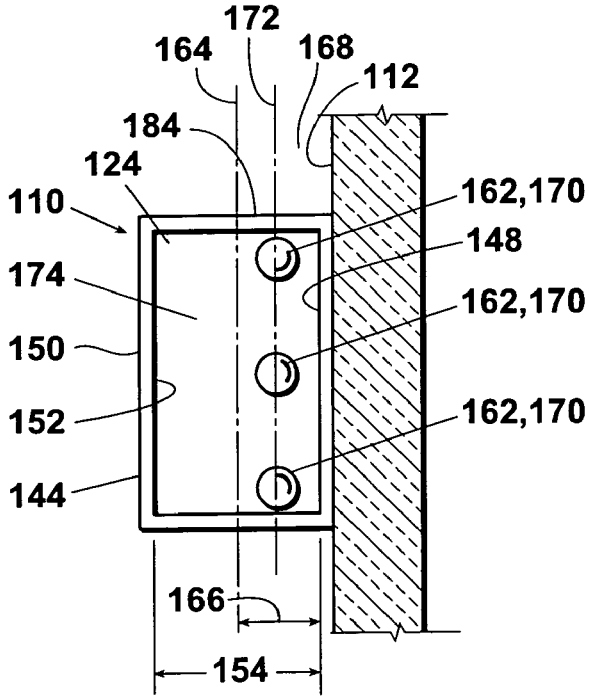
FIG. 4 provides a partial plan view of inventive burner 110 as seen from perspective 4—4 shown in FIG. 3.
Figure 3:
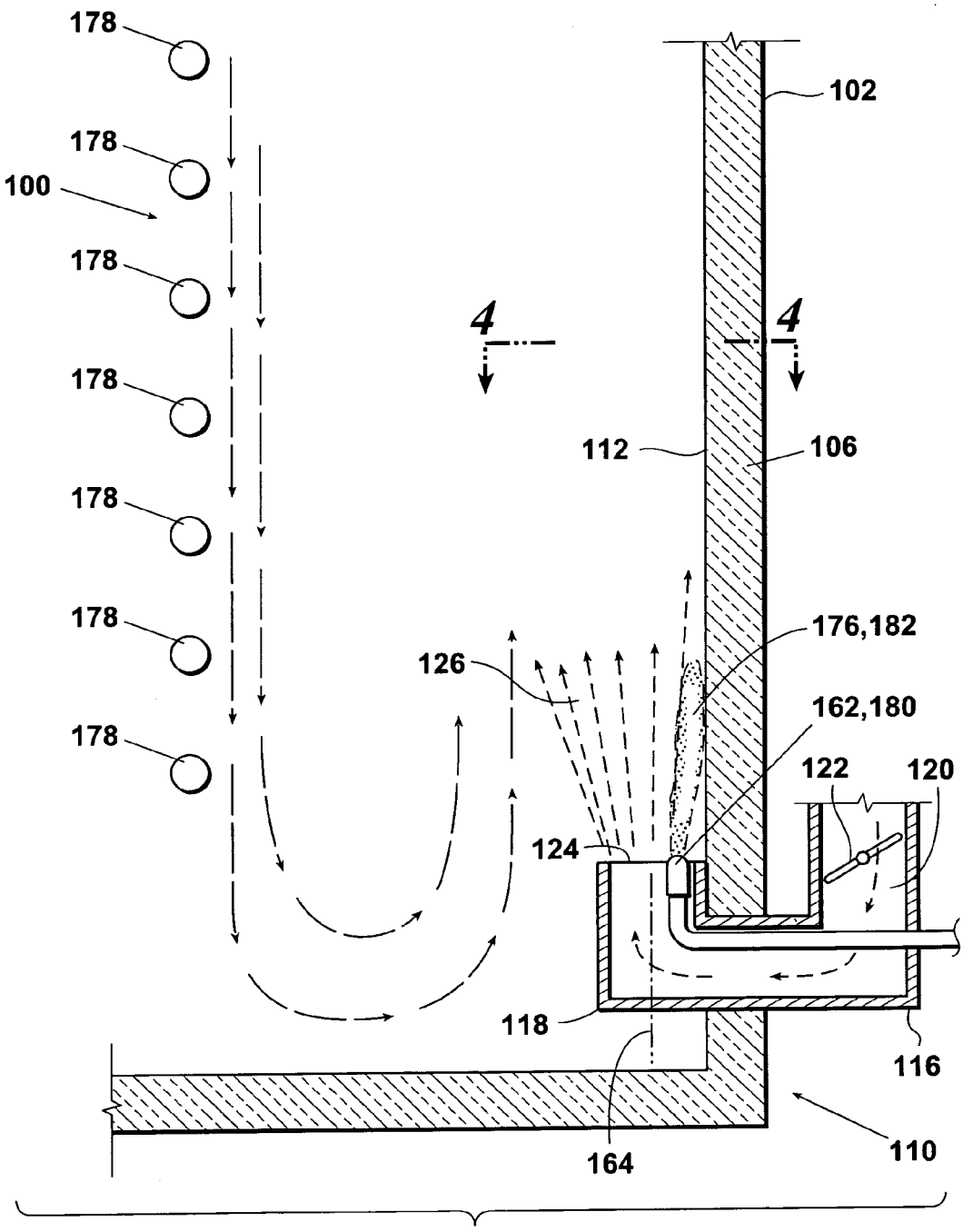
FIG. 3 illustrates an embodiment 100 of the inventive radiant wall heating system which employs an inventive radiant wall burner 110.

An embodiment 100 of the inventive heating system is depicted in FIGS. 3 and 4. The inventive heating system 100 includes at least one inventive improved burner 110. As with the prior art burner 14, the inventive burner 110 includes: a housing 116; a burner wall 118 which extends horizontally from housing 116 through the outer wall 106 and through the radiating internal wall 112 of the heater 102; an air flow passage 120 extending through burner housing 116 and burner wall 118; an air flow damper or other regulator 122 within the burner housing 116; and an upper opening 124 for discharging the combustion air 126 upwardly into heater 102.

In the inventive burner, the upper combustion air opening 124 and peripheral wall 144 surrounding the upper opening 124 can be circular, oval, rectangular (including square), or any other desired shape. As with prior art burner 14, the combustion air opening 124 of inventive burner 110 is rectangular. Consequently, the near boundary 148 of upper opening 126 is a straight line segment which runs parallel to the radiating wall 112. All points on the near boundary line 148 are therefore equidistant from the radiating wall 112 so that each point on line 148 will constitute a near point of the upper opening 124 which is closest to the radiating wall 112. Similarly, the outer boundary 152 of upper opening 124 is also a straight line segment running parallel to the radiating wall 112 so that each point on the outer boundary line 152 will constitute an outer boundary point which is furthest from the radiating wall 112.

Figure 1:
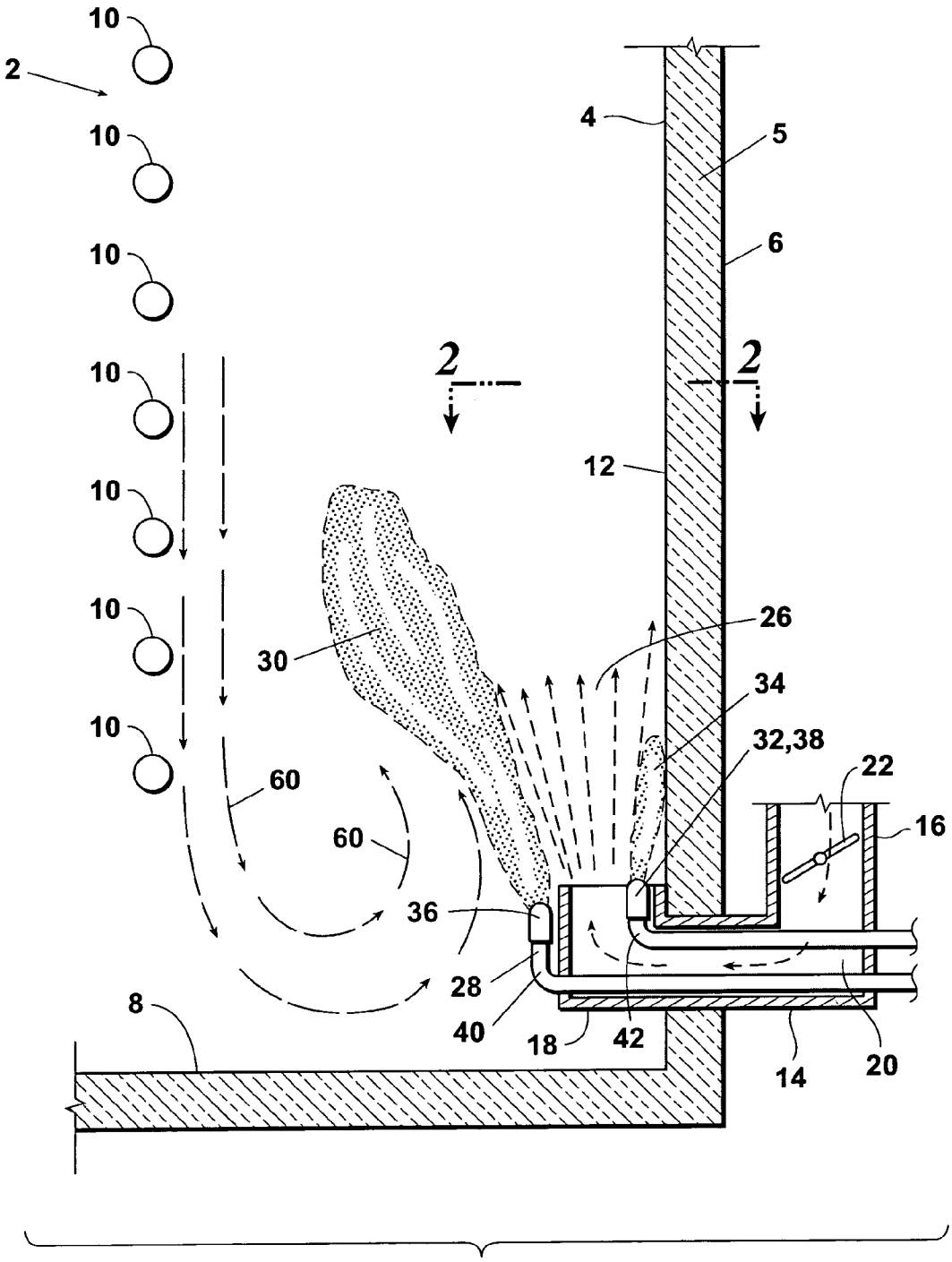
Fig. 1 ( PRIOR ART )
FIG. 1 schematically illustrates a prior art radiating wall heating system 2 using one or more prior art radiant wall burners 14.
Figure 2:
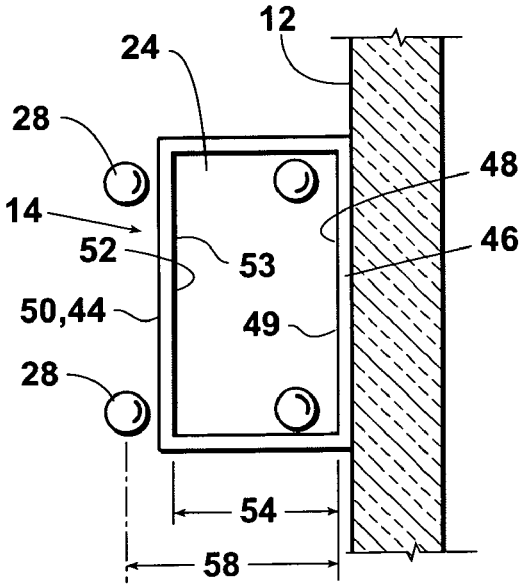
Fig. 2 ( PRIOR ART )
FIG. 2 provides a partial plan view of prior art burner 14 as seen from perspective 2—2 shown in FIG. 1.
Figure 7:
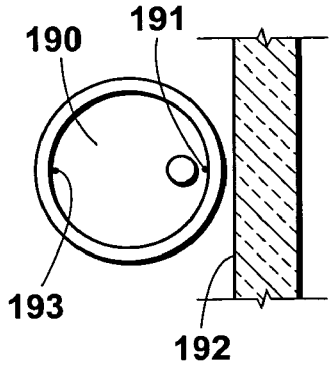
FIG. 7 is a plan view of an alternative embodiment of the inventive burner having a circular air opening 190.

It will be understood however, that if, by way of example, the upper opening 190 of the burner wall were to have an oval or circular shape as illustrated in FIG. 7, then the upper opening would have only a single near boundary point 191 which is closest to radiating wall 192 and only a single outer boundary 193 point which is furthest from radiating wall 192. As another example, if a D-shaped opening 195 of the type illustrated in FIG. 8 were used with the flat side 196 thereof being positioned adjacent and parallel to the radiating wall 197, then each point on the flat side 196 would be a near boundary point closest to the radiating wall 197. However, the D-shaped opening 195 would have only a single outer boundary point 199 located furthest from the radiating wall 197.

The inventive improved burner 110 shown in FIGS. 3 and 4 includes one or more (preferably a plurality of) fuel ejectors 162. In contrast to the prior art burner 14, none of the ejectors 162 of the inventive burner 110 are located in or beyond the outer periphery 150 of the burner wall 118. Each fuel ejector 162 is positioned such that it will be located between the radiating wall 112 and a plane 164. The plane 164 is parallel to radiating wall 112 and is located between the nearest and furthest boundary points 148 and 152 at a distance 166 which is no more than 75% of the maximum width 154 of the upper opening 124. The distance 166 of plane 164 from the near boundary point 148 closest to radiating wall 112 will preferably be not more than 50% of the maximum width 154 of the air discharge opening 124 and will more preferably be not more than 30% of the width 154. The distance 166 of plane 164 from the near boundary point 148 will more preferably be not more than 15%, most preferably not more than 5%, of the maximum width 154 of the combustion air opening 124.

In accordance with these placements of the one or more fuel ejectors 162, less than 75%, preferably less than 50%, more preferably less than 30% or less than 15%, and most preferably less than 5% of the combustion air 126 discharged upwardly from the combustion air opening 124 will be delivered into the heater 102 from the area 168 between the radiating wall 112 and a horizontal line 172 which is parallel to the radiating wall 112. The horizontal line 172 extends through the upper centerpoint 170 of whichever one or more of the fuel ejectors 162 is/are located furthest from the radiating wall 112. By saying that the horizontal line 172 runs through the one or more ejectors 162 which are located furthest from the radiating wall 112, it will be understood that the burner 110 will not have any ejectors positioned outwardly beyond line 172.

By locating the fuel ejectors 162 in the manner described above, the inventive burner ensures that a substantial portion of, and preferably at least most, of the combustion air 126 is discharged upwardly from an area 174 beyond line 172 such that this outer combustion air will operate to both urge the fuel from ejectors 162 toward the radiating wall 112 and shield the ejected fuel from the effects of the internal flue gas currents 160. Thus, the air discharged from the outer area 174 acts to assist in preventing the combustion flame 176 from being pulled outwardly toward or onto the process tubes 178.

Each of the fuel ejectors 162 includes one or more flow ports or orifices 180 which is/are positioned and directed for ejecting the fuel upwardly to produce an upwardly projecting flame pattern 182. As will be understood by those in the art, the upwardly projecting flame pattern will preferably be a flat flame pattern directed against the radiating wall 112. Further, the inventive burner 110 will preferably be a single stage burner having only a single combustion stage zone 182. Because a substantial portion, preferably at least most, of the combustion air 126 is delivered from the outer area 174 beyond line 172, an excess fuel condition will exist in the single stage combustion zone 182. In other words, a sub-stoichiometric amount of oxygen will be present in zone 182 for the complete immediate combustion of the fuel. This slows the combustion rate in zone 182 and thereby lowers the overall flame temperature and reduces the amount of $NO_x$ produced.

Figure 8:
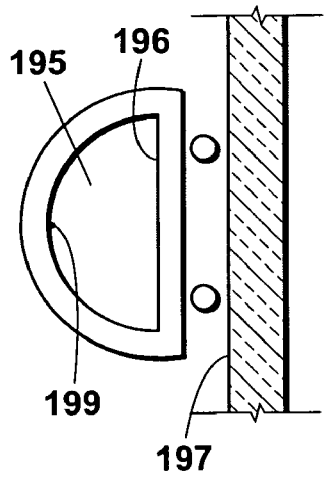
FIG. 8 is a plan view of an alternative embodiment of the inventive burner have a D-shaped combustion air opening 195.

Although each of the fuel ejectors 162 of the inventive burner 110 are shown in FIGS. 3 and 4 as being located within the upper combustion air opening 124, it will be understood that the burner ejectors 162 can be located anywhere between the radiating wall 112 and plane 164. For example, one or more or all of the one or more ejectors of the inventive burner can alternatively be located: (a) outside of a burner side wall 184, (b) within or partially within the near burner wall 146 as illustrated in FIGS. 5 and 6, and/or (c) between the radiating wall 197 and the near burner wall 196 as illustrated in FIG. 8.

Figure 6:
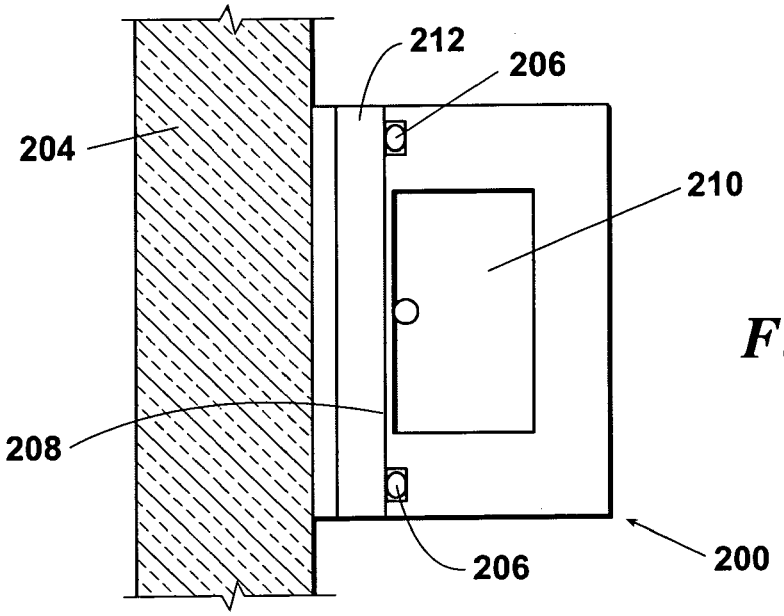
FIG. 6 is a partial plan view of inventive burner 200 as seen from perspective 6—6 shown in FIG. 5.
Figure 5:
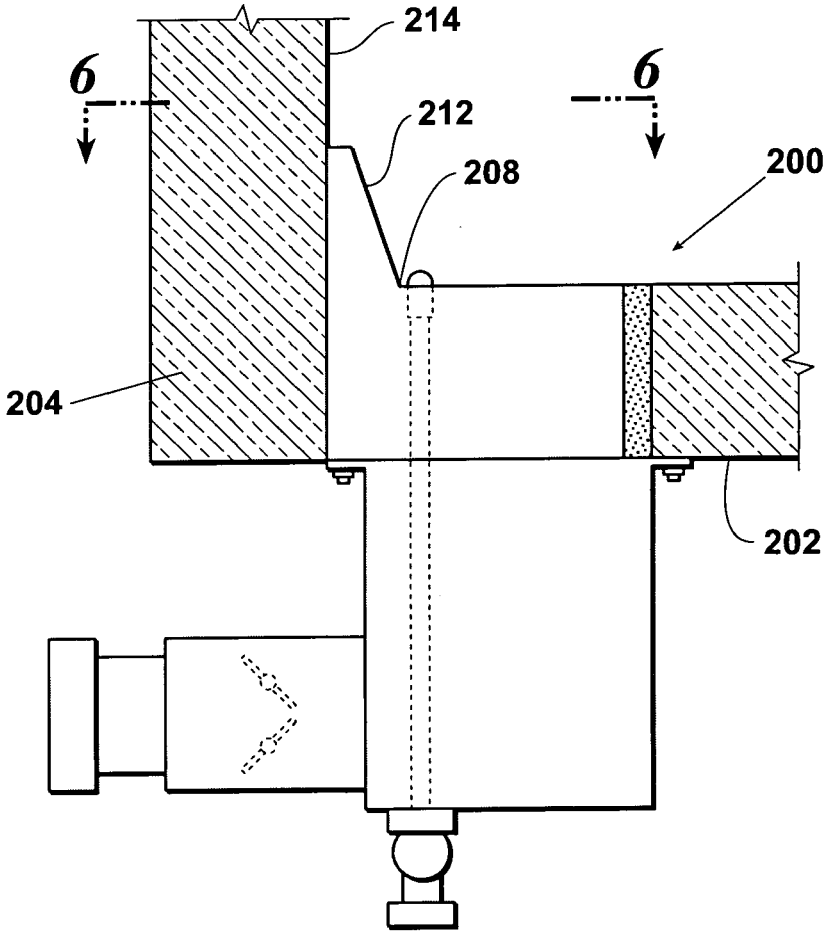
FIG. 5 is an elevational side view of an alternative embodiment 200 of the inventive radiant wall burner.

An alternative embodiment 200 of the inventive burner is illustrated in FIGS. 5 and 6. The inventive burner 200 is substantially the same as inventive burner 110 except that: (a) the burner 200 extends vertically through the floor 202 of the furnace rather than through the side wall 204; (b) two of the fuel ejectors 206 of inventive burner 200 are positioned in the near wall 208 such that they are not located within the air discharge opening 210; and (c) the near wall 208 of the inventive burner 200 includes an upwardly inclined guide wall 212 which assists in guiding the burner flame upwardly against the radiant wall 214.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. In a burner for use in a heating system having an upwardly extending radiating wall for radiating combustion energy, said burner including a burner wall having an upper opening for delivering combustion air upwardly into said heating system, said upper opening having at least one near boundary point which will be closest to said radiating wall and at least one outer boundary point which will be furthest from said radiating wall, said upper opening having a maximum width perpendicular to said radiating wall, and said burner including one or more ejectors for ejecting a fuel, the improvement comprising each said one or more ejectors of said burner being positioned such that it will be located between said radiating wall and a plane parallel to said radiating wall, said plane being located between said near boundary point and said outer boundary point at a distance from said near boundary point of 75% of said maximum width.

2. The burner of claim 1 wherein the improvement further comprises said distance of said plane from said near boundary point being 50% of said maximum width.

3. The burner of claim 2 wherein the improvement further comprises said burner having a plurality of said ejectors.

4. The burner of claim 2 wherein the improvement further comprises said distance of said plane from said near boundary point being 30% of said maximum width.

5. The burner of claim 4 wherein the improvement further comprises said burner having a plurality of said ejectors.

6. The burner of claim 4 wherein the improvement further comprises said distance of said plane from said near boundary point being 15% of said maximum width.

7. The burner of claim 6 wherein the improvement further comprises said burner having a plurality of said ejectors.

8. The burner of claim 2 wherein the improvement further comprises said one or more ejectors being effective for ejecting said fuel in a manner to produce an upwardly projecting flame pattern.

9. The burner of claim 8 wherein the improvement further comprises said upwardly projecting flame pattern being a flat flame pattern.

10. The burner of claim 1 wherein the improvement further comprises:

said burner having only a single combustion stage and said one or more ejectors being effective for ejecting said fuel into said single combustion stage to produce an upwardly projecting flame pattern.

11. The burner of claim 10 wherein the improvement further comprises said upwardly projecting flame pattern being a flat flame pattern.

12. The burner of claim 10 wherein the improvement further comprises said burner having a plurality of said ejectors.

13. The burner of claim 10 wherein the improvement further comprises said one or more ejectors being effective for ejecting said fuel such that a sub-stoichiometric amount of oxygen will be present in said single combustion stage.

14. In a burner for use in a heating system having an upwardly extending radiating wall for radiating combustion energy, said burner including a burner wall having a substantially rectangular upper opening for delivering combustion air, said substantially rectangular upper opening having a first side which will be positioned closest to said radiating wall and a second side, opposite said first side, that will be positioned furthest from said radiating wall, said substantially rectangular upper opening having a width between said first side and said second side, and said burner including one or more ejectors for ejecting a fuel, the improvement comprising each said one or more ejectors of said burner being positioned such that it will be located between said radiating wall and a plane parallel to said radiating wall, said plane being located between said first side and said second side at a distance from said first side which is 75% of said width.

15. The burner of claim 14 wherein the improvement further comprises said distance of said plane from said first side being 50% of said width.

16. The burner of claim 15 wherein the improvement further comprises said burner having a plurality of said ejectors.

17. The burner of claim 15 wherein the improvement further comprises said distance of said plane from said first side being 30% of said width.

18. The burner of claim 17 wherein the improvement further comprises said burner having a plurality of said ejectors.

19. The burner of claim 17 wherein the improvement further comprises said distance of said plane from said first side being 15% of said width.

20. The burner of claim 19 wherein the improvement further comprises said burner having a plurality of said ejectors.

21. The burner of claim 15 wherein the improvement further comprises said one or more ejectors being effective for ejecting said fuel in a manner to produce an upwardly projecting flame pattern.

22. The burner of claim 21 wherein the improvement further comprises said upwardly projecting flame pattern being a flat flame pattern.

23. The burner of claim 14 wherein the improvement further comprises:

said burner having only a single combustion stage and said one or more ejectors being effective for ejecting said fuel into said single combustion stage to produce an upwardly projecting flame pattern.

24. The burner of claim 23 wherein the improvement further comprises said upwardly projecting flame pattern being a flat flame pattern.

25. The burner of claim 23 wherein the improvement further comprises said burner having a plurality of said ejectors.

26. The burner of claim 23 wherein the improvement further comprises said one or more ejectors being effective for ejecting said fuel such that a sub-stoichiometric amount of oxygen will be present in said single combustion stage.

27. A method of producing combustion energy in a heating system having an upwardly extending radiating wall for radiating said combustion energy, said method using a burner having one or more ejectors for ejecting a fuel and an opening for delivering combustion air, said method comprising the steps of:

a. ejecting said fuel from said one or more ejectors in a manner effective for producing an upwardly projecting flame pattern and b. delivering said combustion air from said opening upwardly into said heating system such that less than half of said combustion air from said opening is delivered between said radiating wall and a horizontal line parallel to said radiating wall, wherein said horizontal line is a line extending through an upper end centerpoint of at least one of said one or more ejectors which is located furthest from said radiating wall such that said burner does not have any ejector positioned outwardly from said radiating wall beyond said horizontal line.

28. The method of claim 27 wherein less than 30% of said combustion air from said opening is delivered between said radiating wall and said horizontal line.

29. The method of claim 28 wherein less than 15% of said combustion air from said opening is delivered between said radiating wall and said horizontal line.

30. The method of claim 27 wherein said burner has a plurality of said ejectors.

31. The method of claim 27 wherein said upwardly projecting flame pattern is a flat flame pattern.

32. The method of claim 27 wherein said burner has only a single combustion stage and said one or more ejectors eject said fuel into said single combustion stage in step (a) to produce said upwardly projecting flame pattern.

33. The method of claim 32 wherein said fuel is ejected in step (a) and said combustion air is delivered in step (b) in a manner such that a sub-stoichiometric amount of oxygen will be present in said single combustion stage.

34. The method of claim 32 wherein said burner has a plurality of said ejectors.

35. The method of claim 32 wherein said upwardly projecting flame pattern is a flat flame pattern.

* * * * *